United States Patent [19]

Howitt

[11] Patent Number: 4,473,155

[45] Date of Patent: Sep. 25, 1984

[54] STACKING AND NESTING BIN

[75] Inventor: Robert T. Howitt, Leominster, Mass.

[73] Assignee: Frem Corporation, Worcester, Mass.

[21] Appl. No.: 427,040

[22] Filed: Sep. 29, 1982

[51] Int. Cl.[3] ..... B65D 21/04

[52] U.S. Cl. ..... 206/505; 206/518

[58] Field of Search ..... 206/505, 506, 507, 515, 206/518; 211/126, 127

[56] References Cited

U.S. PATENT DOCUMENTS

| | | | |
|---|---|---|---|
| Re. 26,350 | 2/1968 | Wilson | 206/505 |
| 2,939,607 | 12/1958 | Frater et al. . | |
| 3,003,647 | 10/1961 | Lockwood | 206/505 |
| 3,170,594 | 9/1963 | Nascher . | |
| 3,342,346 | 9/1967 | Tucker | 206/505 |
| 3,398,840 | 10/1966 | Wilson . | |
| 3,478,892 | 11/1969 | Lockwood | 211/126 |
| 3,534,866 | 12/1968 | Asenbauer . | |
| 3,675,815 | 7/1972 | Rehrig . | |
| 3,860,309 | 1/1975 | Brendgord | 211/126 |
| 3,952,903 | 4/1976 | Sanders et al. . | |
| 4,308,954 | 1/1982 | Wilson . | |

FOREIGN PATENT DOCUMENTS

| | | | |
|---|---|---|---|
| 1383917 | 2/1975 | United Kingdom | 206/505 |

*Primary Examiner*—George E. Lowrance

*Attorney, Agent, or Firm*—Blodgett & Blodgett

[57] ABSTRACT

A stacking and nesting bin of generally rectangular configuration having back, bottom and tapered side walls which define a top opening and a front opening. The bin includes spacing means which are effective, when the bin is nested within a second bin to maintain the corresponding walls of the nested bins separated. The bin also includes retaining means which enable the bin to be stacked and retained on a second bin.

20 Claims, 10 Drawing Figures

STACKING AND NESTING BIN

BACKGROUND OF THE INVENTION

The invention relates generally to a stacking and nesting bin for storing merchandise and relates specifically to a stacking and nesting bin of generally rectangular box-like configuration having an open top and an open front.

In recent years, stackable and nestable bins have become increasingly popular for commercial use for storing and displaying merchandise and for domestic use for storing a wide range of items. The stacking feature of the bins maximizes the use of available space and makes the items which are stored in the space readily locatable and easily accessible. The nesting feature of the bins greatly reduces the shipping bulk to stores where they are sold. It also provides a great saving in warehouse storing space and floor space in the stores where the bins are displayed and sold. The storing feature is also very useful in the home.

It is essential that stackable, nestable bins are lightweight, yet are sturdy enough for stacking and supporting merchandise. Many types of bins are provided with matching tabs and slots to ensure that the bins are retained in the stacked position. However, in most cases, the retaining means add a design complexity to the bin. This increases the cost of making the bin, places limitations on the nesting capability of the bin and reduces the aesthetic appeal of the bin. Generally, simplicity in design is preferable for bins. Also, the retaining means do not always securely hold the bins in place when they are stacked.

The bins of the prior art are generally rendered nestable by tapering the vertical walls of the bin so that the lower dimensions of the bin are less than the upper dimensions thereof. This enables a large number of bins to be nested within a relatively small amount of space. However, this also leads to a major problem when the nest of bins are subsequently used for stacking. Because of the tapered walls, each nested bin is tightly wedged in the immediate lower bin. Sometimes it is impossible for an individual to separate the uppermost bin from the group of nested bins. Even if one person holds the group of nested bins while another person grasps the top bin, it is difficult to separate the bins since only a small amount of the top bin is exposed, making it difficult to firmly grasp the top bin. The bins are sometimes dislodged by banging the group of nested bins on the floor or rapping the sides of the bins with the fist. This type of drastic action is annoying and far from satisfactory, and also can result in damage to the bins. These and other difficulties experienced with the prior art bins have been obviated by the present invention.

It is, therefore, an outstanding object of the invention to provide a stacking and nesting bin which is easily separated and removed from a similar bin within which it is nested.

Another object of this invention is the provision of a stacking and nesting bin which includes tapered vertical walls which enable the bin to be nested and also includes means for preventing the bin from being tightly wedged within another similar bin.

A further object of the present invention is the provision of a stacking and nesting bin in which part of the means which maintain the walls of two nested bins separated also function as supporting legs for the bin.

It is another object of the instant invention to provide a stacking and nesting bin having retaining means which are effective when a first bin is stacked above a second bin, to prevent the first bin from being displayed relative to the second bin in any horizontal direction.

A still further object of the invention is the provision of a stacking and nesting bin wherein the retaining means for maintaining a first bin in a stacked position on top of a second bin includes slots and tabs which also function as supporting legs.

It is a further object of the invention to provide a stacking and nesting bin having retaining means for stacking which are relatively unobtrusive with respect to the overall design appearance of the bin.

It is a further object of the invention to provide a stacking and nesting bin which is simple in construction, which is inexpensive to manufacture and which is capable of a long life of useful service.

With these and other objects in view, as will be apparent to those skilled in the art, the invention resides in the combination of parts set forth in the specification and covered by the claims appended hereto.

SUMMARY OF THE INVENTION

The invention comprises a stacking and nesting bin having generally rectangular bottom, back, and side walls which define a top opening and front opening. Retaining means are provided for allowing a first bin to be stacked and retained on top of a second bin. The side walls of the bins are tapered to allow the bins to be nested and spacing means are provided for maintaining the corresponding walls of the nested bins substantially spaced. The invention also comprises a stacking and nesting bin having generally rectangular bottom, back, and side walls which define a top and front opening. Each of the side walls is tapered and includes a top edge surface which is provided with a notch. A pair of spaced retaining tabs extend downwardly from the bottom wall in general vertical alignment with the notches. The tabs of a first bin are adapted to fit into the notches of a second bin to function as locking tabs for stacking the first bin on the second bin. The tabs also function as supporting legs for supporting the bin on a flat supporting surface. More specifically, the means for maintaining the walls of two nested bins separated, includes downwardly extending support tabs which also function as supporting legs for the bin.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
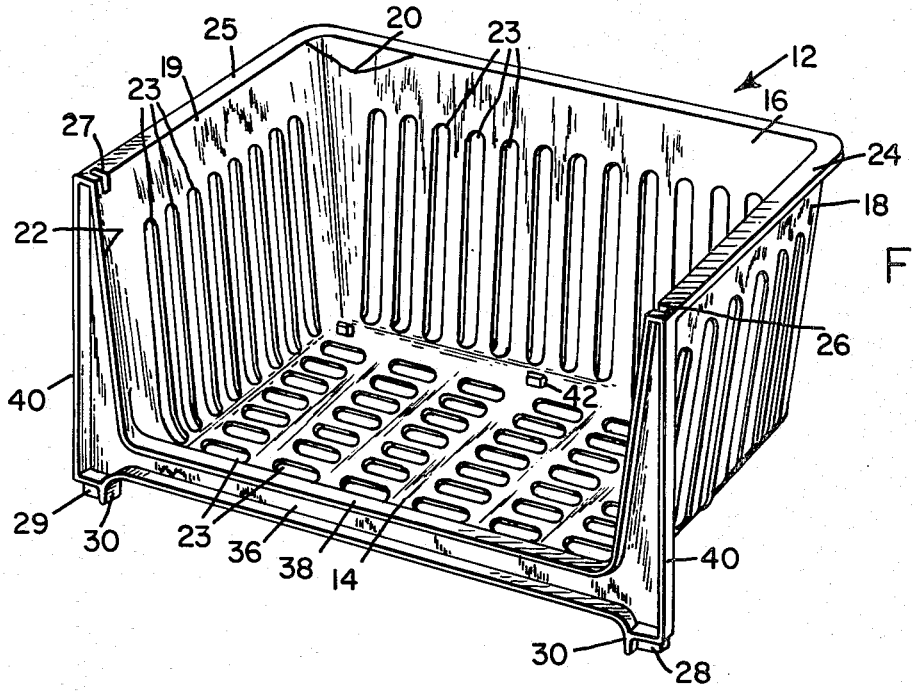
FIG. 1 is a perspective view of a stacking and nesting bin embodying the principles of the present invention.

Reffering first to FIGS. 1–6, the stackable and nestable bin of the present invention is generally indicated by the reference numeral 12. The bin 12 is of general rectangular configuration and consists of a rectangular bottom wall 14, a rectangular back wall 16 and a pair of rectangular right and left hand side walls 18 and 19, respectively. The walls of the bin define a rectangular top opening 20 and a rectangular front opening 22. The side walls 18 and 19 taper outwardly from the bottom wall 14 (as shown more clearly in FIG. 2). All of the walls are provided with a plurality of apertures 23.

The side walls 18 and 19 have top edge surfaces 24 and 25, respectively, which are provided with notches 26 and 27, respectively. The notches 26 and 27 are slightly spaced from the front opening 22 and lie in a vertical plane which is parallel with the front opening 22. Each notch extends downwardly a short distance along the inside portion of its respective side wall and stops short of the outer limit of the top edge surface of its respective side wall, so that the notch is essentially located in the upper inside corner of the wide wall.

Figure 7:
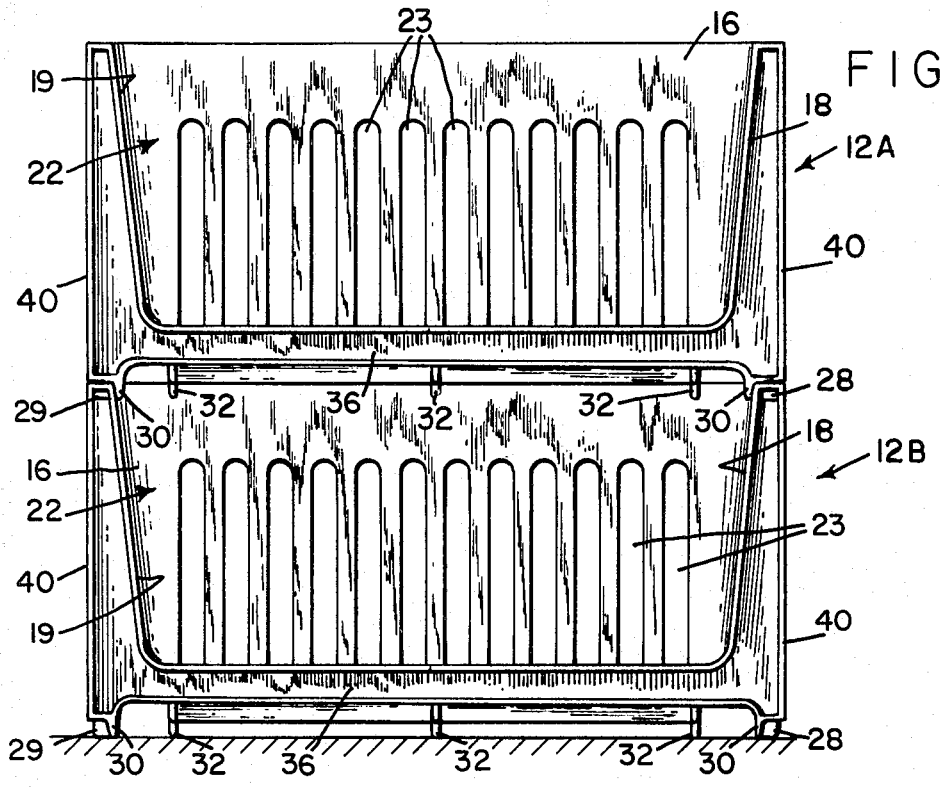
FIG. 7 is a front elevational view of two bins in a stacked relationship.

A pair of tabs 28 and 29 extend downwardly from the bottom wall 14 and are vertically aligned with the notches 26 and 27. The notches 28 and 29 are adapted to be inserted into the notches 26 and 27, respectively, of a second identical bin to function as retaining means when the bin is stacked on top of an identical second bin as shown in FIG. 7. Referring particularly to FIG. 7, a first bin 12A is shown in a stacked position on top of a second bin 12B. The tabs 28 and 29 of bin 12A, extend into the notches 26 and 27 of bin 12B. Since the notches 26 and 27 are spaced from the front opening 22, and occupy the inner corners of their respective side walls, the upper bin 12A is retained against movement in any horizontal direction. Each tab is also provided with a reinforcing flange 30 which extends at a right angle to the tab and lies in a front to back vertical plane. When two bins are stacked as shown in FIG. 7, the flanges 30 of the top bin 12A extend along the inside surfaces of the side walls 18 and 19 of the bottom bin 12B and render the upper bin 12A more stable against horizontal displacement relative to the lower bin 12B. The tabs 28 and 29 also function as supporting legs which maintain the bottom wall 14 of the bin placed from the supporting surface for the bin.

Figure 2:
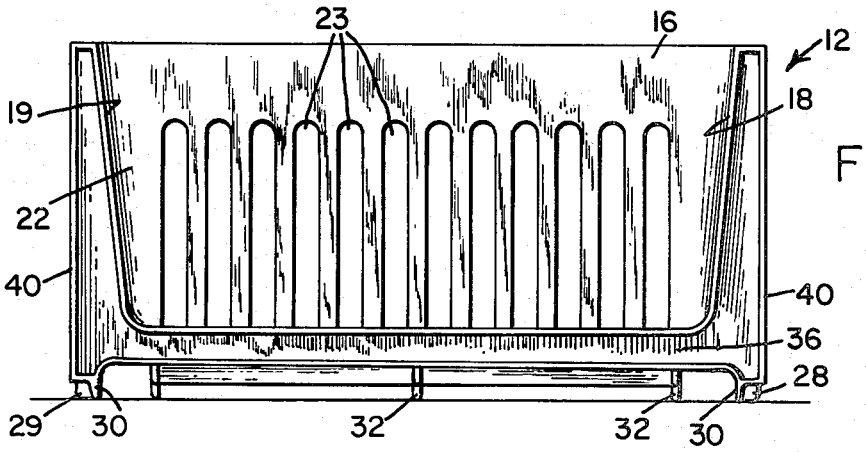
FIG. 2 is a front elevational view of the bin.
Figure 3:
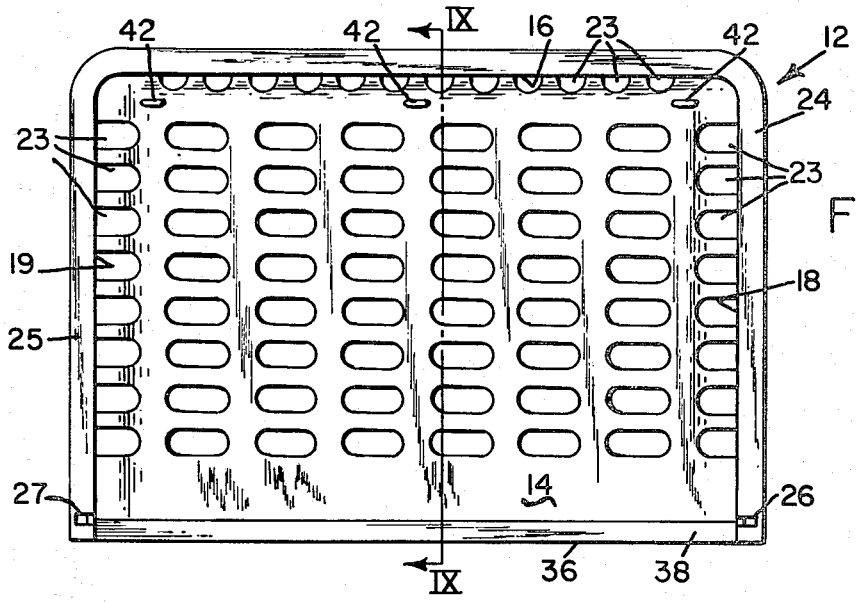
FIG. 3 is a top plan view of the bin.
Figure 4:
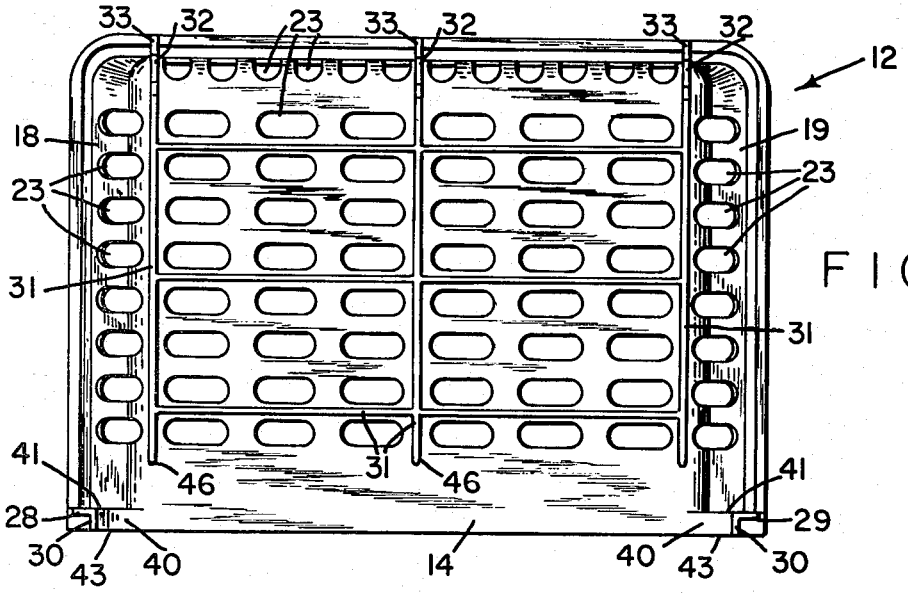
FIG. 4 is a bottom plan view of the bin.
Figure 5:
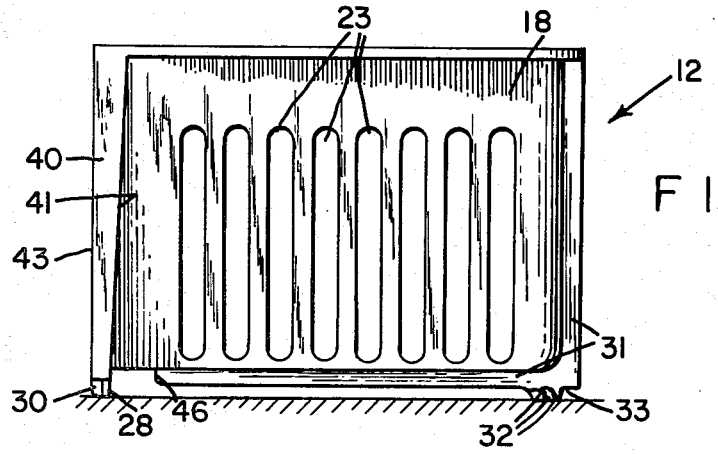
FIG. 5 is an elevational view of the right hand side of the bin.
Figure 6:
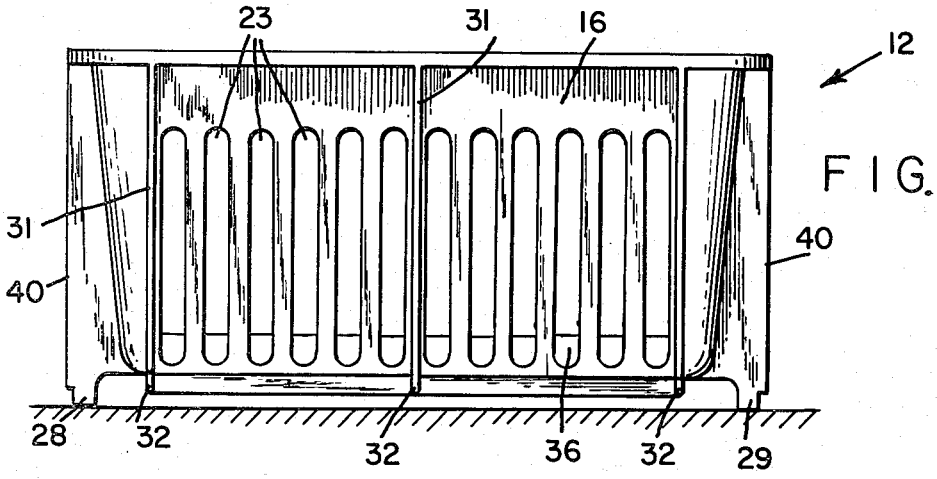
FIG. 6 is a rear elevational view of the bin.
Figure 8:
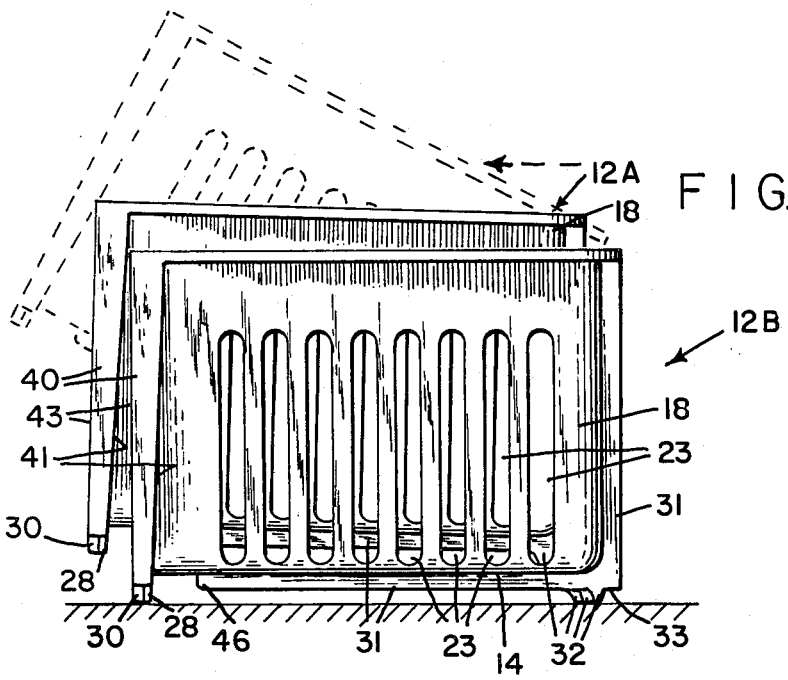
FIG. 8 is a right-hand side elevational view of two bins in a nested relationship.
Figure 9:
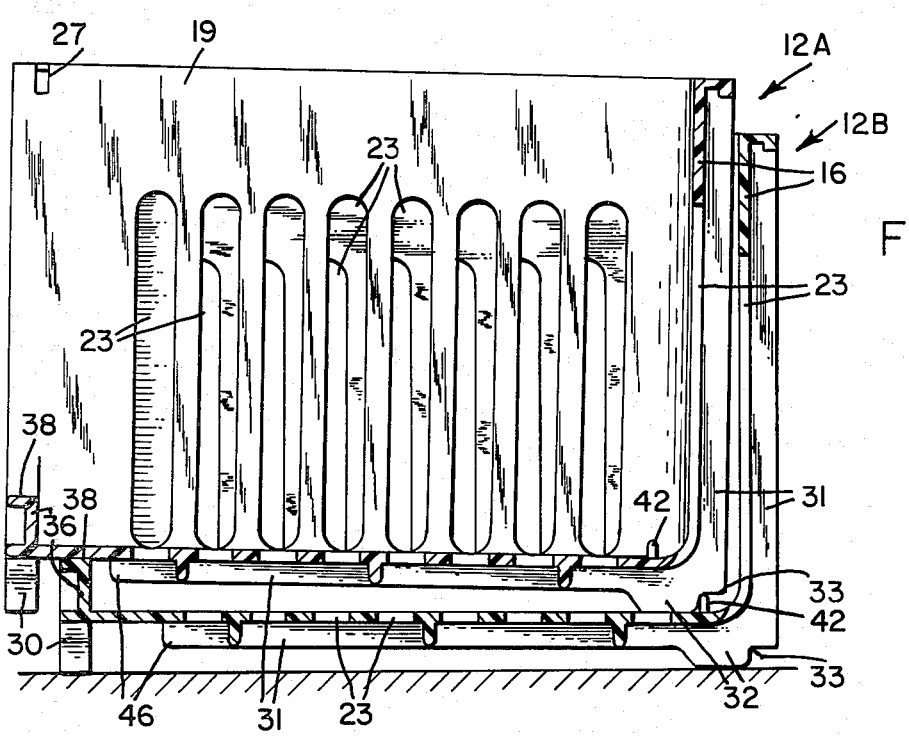
FIG. 9 is a vertical sectional view of a pair of nested bins, this section being taken along line IX—IX of FIG. 3.

Referring particularly to FIGS. 2, 4, and 5, the bin 12 is also provided with three support tabs 32 which extend downwardly from the bottom surface 14. Two of the support tabs 32 are located adjacent the side walls 18 and 19, respectively, and the third support tab is located intermediate the first two. The support tabs 32 maintain the bottom walls 14 of two adjacent nested bins separated as shown in FIGS. 8 and 9. The tabs 32 also function as rear support legs when the bin is supported on a flat supporting surface or nested within another bin. The bin 12 includes a short wall 36 which has a flat top edge surface 38 which defines the bottom limit of the front opening 22. The short front wall 36 extends upwardly from the bottom wall 14 at a distance which is slightly greater than the distance that the support tabs 32 extend downwardly from the bottom wall 14. When two bins are nested as shown in FIGS. 8 and 9, the support tabs 32 of the upper bin 12A rest on the top surface of the bottom wall 14 of the lower bin 12B and the bottom surface of the bottom wall 14 of bin 12A rests on the surface 38 of the front wall 36 of the bottom bin 12B. Since the length of the wall 36 is slightly greater than the length of the tabs 32, the back portion of the bin 12A is closer to the bottom surface 14 of the bin 12B than the front portion of the bin 12A.

Each tab 32 is part of a rib 31 which extends along the underside of the bottom wall 14 and along the outside of the back wall 16. The tab 32 is located slightly forward of the rear extremity of the rib 31 so as to form a notch 33 just behind the tab. When two bins are stacked as shown in FIG. 7, the top edge of the back wall 16 of the lower bin 12B fits into the notch 33 of the upper bin 12A and the tab 32 extends against the inner surface of the back wall.

Each of the side walls 18 and 19 is provided with an outwardly extending flange 40 which includes a forward edge 43 and a rearward edge 41. When two bins are in the nested position as shown in FIGS. 8 and 9, the rearward edge 41 of the upper bin 12A abuts the forward edge 43 of the bin 12B which maintains the rear walls 16 of the bins 12A and 12B separated. The bottom wall 14 is also provided with upwardly extending stops 42. When the bins are in the nested position, the stops 42 of the lower bin 12B engage the support tabs 32 of the upper bin 12A as shown more clearly in FIG. 9. This also helps to maintain the rear walls 16 of the bins separated.

The forward end of each rib 31 terminates at a point which is rearward of the front wall 36 and constitutes a front stop 46. When two bins are nested as shown in FIG. 9, the front stops 46 of the upper bin 12A sit just behind the front wall of the lower bin 12B, so that the upper bin is retained against forward movement relative to the lower bin.

The operation and advantages of the present invention will now be readily understood in view of the above description. When a bin 12 is supported by a flat supporting surface, the retaining tabs 28 and 29 function as front supporting legs, and the support tabs 32 function as rear supporting legs to maintain the bottom wall 14 spaced from the supporting surface which, together with apertures 23 in the bottom wall 14, provide ventilation to the lower portion of the bin. This is an important factor for maintaining fruits and vegetables fresh. This also prevents soiling and contamination of the goods from the supporting surface. When two bins are stacked (as shown in FIG. 7), the tabs 28 and 29 of the upper bin 12A extend into the notches 26 and 27, respectively of the lower bin 12B and the notches 31 of the tabs 32 of the upper bin 12A rest on the top edge surface of the back wall 16 of the lower bin 12A so that the support tabs 32 abut the inner surface of the back wall. In this way, the upper bin 12A is securely supported on the lower bin 12B and is restrained against all horizontal dis-placement relative to the lower bin 12B. If desired, a third bin can be added to the top of the bin 12A, a fourth bin added to the third bin, etc.

Figure 10:
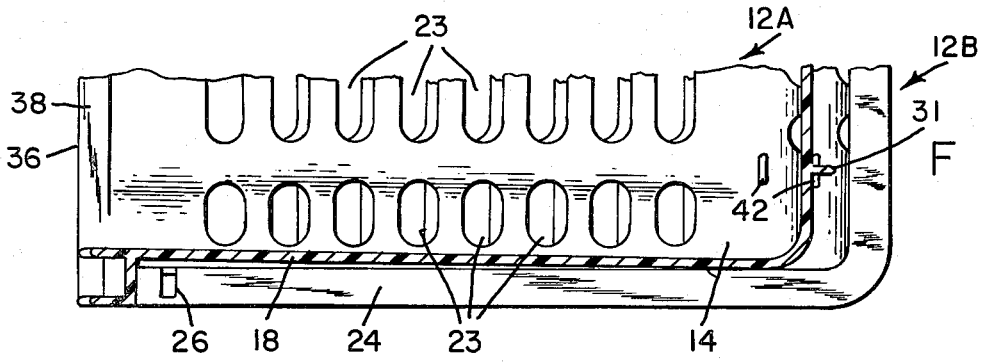
FIG. 10 is a fragmentary horizontal sectional view of a pair of nested bins taken along the line X—X of FIG. 8.

The bin 12 is nestable with other identical bins as illustrated in FIGS. 8–10. When two bins 12 are nested as shown in FIGS. 8–10, the lower bin 12B is supported on a flat supporting surface and the upper bin 12A is supported within the lower bin 12B. The support tabs 32 of the upper bin 12A rest on the bottom surface 14 of the lower bin 12B and the bottom surface 14 of the upper bin 12A rests on the top edge surface 38 of the front wall 36 of the lower bin 12B. Since the front wall 36 is slightly longer than the support tabs 32, the rear portion of the upper bin 12A sets a little lower than the front portion thereof within the lower bin 12B, as illustrated in FIGS. 8 and 9. Since the side walls 18 and 19 are tapered, the rear portions of the adjacent side walls of the bins 12A and 12B abut and the forward portions of the adjacent side walls are slightly spaced as shown in FIG. 10. The spacing between the adjacent side wall is indicated by the reference numeral 44 in FIG. 10 and is shown slightly exaggerated for illustration purposes. The rear walls 16 of the bins 12A and 12B are maintained spaced by the flanges 40 of the upper bin 12A and the stops 42 of the lower bin 12B which abut the support tabs 32 of the upper bin 12A. When the bins are nested, the front stops 46 of the upper bin 12A lie behind the front wall 36 of the lower bin 12B so that the upper bin 12A is retained against accidental forward movement relative to the lower bin 12B. However, if it is desired to separate the upper bin 12A from the lower bin 12B, the front wall 36 is grasped and lifted upwardly to the dotted line position as shown in FIG. 8. Since the front portions of the side walls of the nested bins are separated, the front of the upper bin 12A is easily lifted away from the lower bin 12B. The rear portions of the side walls of the bins 12A and 12B, abut along a relatively small contact area. When the front portion of the bin 12A is lifted, the rear portion of the bin 12A pivots on the lower bin 12B. Because of the front to back angularity of the top bin within the bottom bin, the upper rearward portions of the adjacent side walls engage more tightly than the lower rearward portions thereof. By lifting the forward portion of the top bin 12A, a slight amount, the lower rearward portion of each side wall of the bin 12A pulls away from the adjacent side wall of the lower bin 12B that there is essentially a point contact between the upper outer surface of the side wall of the upper bin 12A on the extreme upper inside surface of the side wall of the lower bin.

Once that the top bin 12A has been swung upwardly to the dotted line position as shown in FIG. 8, it can be easily lifted out of the bottom bin 12B. However, if the front portion of the upper bin 12A is swung upwardly beyond the dotted line position shown in FIG. 8, the rearward edge of the back wall 19 of the other bin 12A strikes the top edge of the back wall 19 of the bin 12B. The upper edge of the back wall 19 of the top bin 12A therefore pivots on the upper edge of the back wall 19 of the bin 12B, causing the side walls of the bin 12A to pull away completely from the side walls of the bin 12B. The top bin 12A can be lifted free of the bottom bin 12B without any resistance whatsoever. In actual practice, it has been found that there is so little resistance to pivoting the upper bin 12A relative to the lower bin 12B from the full line position to the dotted line position as shown in FIG. 8, that the pivoting motion can be accomplished with a single finger. The front wall 36 is then grasped by the thumb and the top bin 12A lifted clear of the bottom bin 12B.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Stacking and nesting bin comprising:

(a) a rectangular bottom wall, (b) a rectangular back wall extending upwardly from the bottom wall, (c) a pair of side walls extending upwardly and outwardly from said bottom wall and attached to said back wall so that the bin has a top opening and a front opening, each of said side walls having a top edge surface which is provided with a notch, (d) a pair of spaced retaining tabs extending downwardly from said bottom wall in general vertical alignment with said notches, respectively, said tab being adapted to a function as supporting legs for the bin on a flat supporting surface and adapted to fit into the notches of an identical second bin to function as retaining tabs for stacking the bin on said second bin, (e) a pair of spaced support tabs which extend downwardly from the bottom wall on the rearward portion of the bin to function as rear support legs when said bin is located on a flat supporting surface or nested within a second identical bin, and (f) a short front wall which extends upwardly from the bottom wall to define the bottom limit of said front opening, so that when a first of said bin is nested within a second of said bin, the respective bottom walls of the bins are spaced, said support tabs and said front wall being of sufficient length to maintain the side walls of said first bin spaced from the corresponding side walls of said second bin when said bins are nested, wherein the relative length of said support tabs and said front wall are such that when said first and second bins are nested, the spacing between the bottom walls of said bins is greater at the forward portions of the bins than at the rearward portion thereof, so that the spacing between adjacent side walls of the bins gradually diminishes from front to back to a relatively small contact area at the extreme rearward portions of said adjacent side walls.

2. Stacking and nesting bin as recited in claim 1, wherein the retaining tabs are located on the forward portion of the bin.

3. Stacking and nesting bin as recited in claim 1, wherein each of said notches is slightly spaced from said front opening and is located at the upper inner corner of the side wall within a vertical side to side plane, and each of said tabs is located in said plane, and each of said tabs is located in said plane, so that insertion of the tabs of a first of said bin into the respective notches of a second of said bin prevents movement of said first bin relative to said second bin in any horizontal direction.

4. Stacking and nesting bin as recited in claim 3, wherein each of said tabs has an inner reinforcing flange which lies in a vertical front to back plane so that the flange of said first bin abuts the inner surface of the side wall of said second bin.

5. Stacking and nesting bin as recited in claim 1, wherein one of said support tabs is in general vertical alignment with one of said side walls and the other of said support tabs is in general vertical alignment with the other of said side walls, both of said support tabs being in general vertical alignment with said back wall.

6. Stacking and nesting bin as recited in claim 5, wherein there is a third supporting tab which extends below the bottom wall and intermediate said pair of support tabs.

7. Stacking and nesting bin as recited in claim 1, wherein means are provided for maintaining the back wall of said first bin spaced from the back wall of said second bin when the bins are nested.

8. Stacking and nesting bin as recited in claim 7, wherein the means for maintaining said back walls spaced comprises an outwardly extending flange on each side wall of the bin adjacent the front opening.

9. Stacking and nesting bin a recited in claim 6, wherein the means for maintaining said back walls spaced comprise stops which extend upwardly from the bottom wall adjacent the back wall.

10. Stacking and nesting bin as recited in claim 9, wherein the stops of said first bin abut the support tabs of said second bin when the bins are nested.

11. Stacking and nesting bin comprising:

(a) a rectangular bottom wall, (b) a rectangular back wall extending upwardly from the bottom wall, (c) a pair of side walls extending upwardly and outwardly from said bottom wall and attached to said back wall so that the bin has a top opening and a front opening, (d) back spacing means extending downwardly from the bottom wall at the rearward portion of the bin, and (e) forward spacing means extending upwardly from the bottom wall at the forward portion of the bin so that when a first of said bin is nested into a second of said bin, the bottom walls of both of said bins are maintained spaced from each other, wherein the forward and rearward spacing means of sufficient length so that the corresponding side walls of said nested bins are substantially spaced from each other, and wherein the length of said forward and rearward spacing means are such that the spacing between the bottom walls of said nested bins is slightly greater at the front portion of the bins relative to the back portion of the bins, so that the spacing of adjacent side walls of the nested bins gradually diminishes from front to back to a relatively small contact area at the extreme rearward portions of said adjacent side walls.

12. Stacking and nesting bin as recited in claim 11, wherein additional spacing means is provided for maintaining the back walls of said nested bins spaced.

13. Stacking and nesting bin as recited in claim 12, wherein said additional spacing means comprises an outwardly extending flange on each side wall of the bin adjacent the front opening.

14. Stacking and nesting bin as recited in claim 12, wherein said additional spacing means comprises stops which extend upwardly from the bottom wall adjacent the back wall.

15. Stacking and nesting bin as recited in claim 11, wherein the forward spacing means is a short front wall which extends upwardly from the bottom wall to define the bottom limit of said front opening.

16. Stacking and nesting bin as recited in claim 15, wherein a forward stop extends downwardly from the bottom wall and rearwardly of the front wall so that when said first bin is nested into said second bin, the forward stop of said first bin lies behind the front wall of said second bin, whereby the first bin is retained against forward movement relative to the second bin.

17. Stacking and nesting bin as recited in claim 11, wherein the back spacing means comprises support tabs which extend downwardly from the bottom wall on the rearward portion of the bin.

18. Stacking and nesting bin comprising:

(a) a rectangular bottom wall, (b) a rectangular back wall extending upwardly from the bottom wall, (c) a pair of side walls extending upwardly and outwardly from said bottom wall and attached to said back wall so that the bin has a top opening and a front opening, (d) retaining means on one or more of said walls for allowing a first of said bin to be stacked and retained on top of a second of said bin, and (e) spacing means extending from one or more of said walls for maintaining corresponding walls of said bins substantially spaced when the bins are nested, said spacing means being effective to cause said first bin to slope downwardly slightly from front to back when said first bin is nested in said second bin, so that the spacing between the corresponding side walls of said nested bins gradually diminishes from front to back to a relatively small contact area at the extreme rearward portions of said corresponding side walls.

19. Stacking and nesting bin as recited in claim 18, wherein the retaining means is effective to prevent said first bin from being moved horizontally in any direction relative to said second bin said first bin is stacked on said second bin.

20. Stacking and nesting bin as recited in claim 19, wherein said retaining means comprises a notch at the top of each side wall and a retaining tab extending downwardly from each side wall, the tabs of said first bin being adapted to fit into the corresponding notches of said second bin.

* * * * *